US006775925B2

(12) United States Patent
Zagar et al.

(10) Patent No.: US 6,775,925 B2
(45) Date of Patent: Aug. 17, 2004

(54) WATER SPRAY WEB COOLING APPARATUS FOR WEB DRYER

(75) Inventors: Steven J. Zagar, Luxemburg, WI (US); Paul Seidl, DePere, WI (US); Jerry Packer, Appleton, WI (US); David Welter, Chargrin Falls, OH (US)

(73) Assignee: Megtec Systems Inc., DePere, WI (US)

( * ) Notice: Subject to any disclaimer, the term of this patent is extended or adjusted under 35 U.S.C. 154(b) by 0 days.

(21) Appl. No.: 10/276,239

(22) PCT Filed: May 1, 2001

(86) PCT No.: PCT/US01/40649

§ 371 (c)(1),
(2), (4) Date: Apr. 14, 2003

(87) PCT Pub. No.: WO01/88448

PCT Pub. Date: Nov. 22, 2001

(65) Prior Publication Data

US 2003/0145481 A1 Aug. 7, 2003

Related U.S. Application Data

(60) Provisional application No. 60/204,856, filed on May 17, 2000.

(51) Int. Cl.[7] ..... F26B 13/00; F26B 21/06

(52) U.S. Cl. ..... 34/618; 34/643; 34/465; 34/430; 34/448

(58) Field of Search ..... 34/421, 425, 61, 34/68, 83, 618, 643, 465, 329, 337, 343, 348, 357, 430, 448, 460, 508, 509, 621; 101/487, 488, 424.1

(56) References Cited

U.S. PATENT DOCUMENTS

| | | | | |
|---|---|---|---|---|
| 3,823,488 A | | 7/1974 | Houben et al. | 34/156 |
| 4,242,808 A | * | 1/1981 | Luthi | 34/459 |
| 4,244,078 A | * | 1/1981 | Hughes et al. | 15/302 |
| 5,070,628 A | | 12/1991 | Zagar | 34/156 |
| 5,333,395 A | * | 8/1994 | Bulcsu | 34/79 |
| 5,555,635 A | * | 9/1996 | Seidl | 34/79 |
| 5,642,671 A | | 7/1997 | Winheim | 101/424.1 |
| 6,223,448 B1 | | 5/2001 | Motzke et al. | 34/61 |

* cited by examiner

*Primary Examiner*—K. B. Rinehart
(74) *Attorney, Agent, or Firm*—Mitchell D. Bittman; Kevin S. Lemack

(57) ABSTRACT

Apparatus and a method for the evaporative cooling of a web within a dryer in a compact manner. Excess fluid overspray is controlled, thereby avoiding problems with fluid depositing on internal surfaces of the dryer, which can cause mineral build-up and can result in web breaks or quality defects if fluid drips onto the web. More specifically, a water delivery system is used which directs a water mist to the web by appropriate design and placement of the spray nozzles. The quantity of water delivered to the web is regulated, and is preferably based upon web temperature. Excess mist is controlled by directing hot air to effectively vaporize the excess mist before it is able to contact the internal surfaces of the dryer enclosure and its internal components.

22 Claims, 5 Drawing Sheets

WATER SPRAY WEB COOLING APPARATUS FOR WEB DRYER

This application is a 371 of PCT/US01/40649 filed May 1, 2001 which claims benefit of provisional No. 60/204,856 filed May 17, 2000.

BACKGROUND OF THE INVENTION

The present invention relates to apparatus for cooling and/or remoistening of a moving web.

In drying a moving web of material, such as paper, film or other sheet material, it is often desirable that the web be contactlessly supported during the drying operation in order to avoid damage to the web itself or to any ink or coating on one or more of the web surfaces. A conventional arrangement for contactlessly supporting and drying a moving web includes upper and lower sets of air bars extending along a substantially horizontal stretch of the web. Heated air issuing from the air bars floatingly supports the web and expedites web drying. The air bar array is typically inside a dryer housing which can be maintained at a slightly subatmospheric pressure by an exhaust blower that draws off the volatiles emanating from the web as a result of the drying of the ink thereon, for example.

It is often necessary to cool and/or remoisten the web after it has been dried. For example, U.S. Pat. No. 5,333,395 discloses a drying apparatus for traveling webs which includes a cooling tunnel directly connected with the dryer, a combustion chamber for combusting solvent which becomes volatile during drying of the web, heat exchangers, etc. U.S. Pat. No. 5,038,495 discloses a cooling device for cooling a web of material exiting a dryer. The cooling device comprises a substantially closed housing with an inlet and an outlet slit for the web of material. The housing includes a feed aperture at the outlet slit side for feeding outside air into the housing, and a discharge aperture at the inlet slit side for discharging air from the housing into the dryer. Air is fed through the housing counterflow to the direction of web travel. A series of nozzles bring the infed air into contact with the web of material.

Once the traveling web exits a dryer, it is often brought into partial wrapping engagement around a rotating roller or "chill roll" so that the web can have substantial intimate contact with the cylindrical surface of the roller for heat transfer purposes to rapidly cool the web. A problem that has persisted in connection with such processes is the tendency for a film of air to intrude between the web and the cylindrical surface of the roller, thereby inhibiting effective contact (and thus heat transfer) between them. It is known that a relatively thin "boundary layer" of air is picked up by the moving surfaces of the web and the roller and that some of this air becomes trapped in the wedge-shaped space where the web approaches the roller surface. Unless the web is under a relatively high lengthwise tension, or is moving lengthwise at a relatively low speed, the trapped air enters between the roller and the portion of the web that curves around it, forming a film between the roll and the curved web portion. It will be evident that where a web is to be heated or cooled by a roller around which it is partially wrapped, an insulating film of air between the web and the roller will materially reduce the efficiency of the heat transfer. In addition, where the prior drying operation is drying ink or some other coating that has been applied on the web, the air film that is carried with the moving web may result in solvent condensing on the chill roll surface. The result can be condensate marking, streaking, spotting and/or smudging of the printed web. At higher press speeds (dependent upon web tension and chill roll diameter), the accumulation (thickness) of the condensate film increases and may transfer to the printed web, thereby affecting quality and salability of the finished product. The accumulation and thickness of the condensate is associated with the air gap developed between the web and the chill roll surface, and results in the phenomenon of "web lift-off," a clearance gap between the web proper and the surface of the roll.

After being heated by the dryer and cooled by suitable means such as a chill roll stand, the web has generally lost a significant amount of its moisture. Excessive moisture loss can cause deleterious curling or waviness of the web.

In heatset web offset printing, a printed web is typically heated in an air flotation dryer to about 250° F. or higher to remove mineral oil solvents from the printing ink. Approximately 90% of the mineral oil solvents are removed in the dryer and carried away in the dryer ventilation exhaust air. It is impractical to remove all of the mineral oil solvents in the drying process, since this would be detrimental to the quality of the printed product. The approximately 10% residual solvents remaining in the ink and paper are essentially non-volatile at room temperature. These residual solvents become particularly problematic as the web exits the dryer and initially cools; the residual ink solvents exhibit sufficient volatility to give off solvent vapors, which condense in the surrounding ambient air causing visible smoke. The condensed solvents often deposit on subsequent web processing equipment such as the chill rolls and folding equipment, causing problems of image marking and re-softening of the dried ink on the web.

Various devices such as smoke tunnels and smoke hoods have been used to either contain or direct the solvent vapors during the cooling process to minimize these problems. However, such equipment often becomes contaminated with condensed solvent, which may drip on the web, causing severe quality and productivity problems. Cooling zones, which direct tempered air to the web via flotation nozzles in order to promote cooling without solvent vapor condensation, also have been applied but with limited success in totally eliminating vapor smoke. Such zones cannot cool very rapidly and consequently must be very large and expensive in order to be effective.

Cooling by spraying fine water droplets onto the web have found good success in controlling vapor smoke. However, difficulties arose in promoting a majority of the water droplets to contact the web where they evaporate and remove heat from the web effectively. Local air currents and air film (boundary layer) near the web surface prevent fine droplets from reaching the web surface and reduce the effectiveness of cooling. Furthermore, water spray directed near or beyond the edges of the web does not evaporate by contact with the web, but rather may deposit on other surfaces within the enclosure containing the spray devices and subsequently evaporate. Such deposition cools such surfaces and promotes solvent vapors to condense thereon, causing solvent drips as mentioned above.

Printed or coated webs are processed in a variety of widths according to the requirements of the production order. A spray cooling apparatus such as that of the present invention must have the ability to process the maximum design web width of the printing press as well as small widths, such as webs with widths only 25% of the maximum width. Furthermore, the webs with narrower widths may run at various positions within the maximum width of the press line. Conventional methods of handling the different web widths attempted to inactivate those nozzles positioned outside of the active web width. This required a number of automatic systems to set the water flow valves properly. It therefore would be desirable to effectively and efficiently lower the bulk temperature of the web in order to decrease the heat load of the cooling or chill rolls, or even eliminate the chill rolls or other cooling means such as an air-based cooling zone. Lowered web bulk temperature decreases the evaporation rate of the solvent mixture coating the web, thereby reducing the visible vapors evolving from the web. Condensation that normally occurs at the dryer exit and on the cooling rolls is controlled to a minimum, and the product quality of the web is improved in view of the absence of excessive moisture loss from the web.

It also would be desirable to maximize the contact of water with the web for cooling, and to avoid contact of water droplets on internal surfaces of the device and its enclosure.

It would be further desirable to provide an apparatus and method for the evaporative cooling of a web that accommodated webs having a variety of widths without costly and complicated equipment.

SUMMARY OF THE INVENTION

The problems of the prior art have been overcome by the present invention, which provides apparatus and a method for the evaporative cooling of a web within a dryer in a compact manner. Excess fluid overspray is controlled, thereby avoiding problems with fluid depositing on internal surfaces of the dryer, which can cause mineral build-up and can result in web breaks or quality defects if fluid drips onto the web. More specifically, a water delivery system is used which directs a water mist to the web by appropriate design and placement of the spray nozzles. The quantity of water delivered to the web is regulated, and is preferably based upon web temperature. Excess mist is controlled by directing hot air to effectively vaporize the excess mist before it is able to contact the internal surfaces of the dryer enclosure and its internal components.

DETAILED DESCRIPTION OF THE INVENTION

The preferred location of the spray cooling apparatus of the present invention is in the web exit zone of a flotation dryer, or immediately following the location where the web exits the dryer. A spray manifold arrangement is thus placed in a dryer housing or within a housing extension added to the dryer, and is compact in length, preferably less than 30 inches in the direction of web travel. Although other fluids can be sprayed, water is the preferred fluid and will be used hereinafter as the illustrative example.

Figure 1:
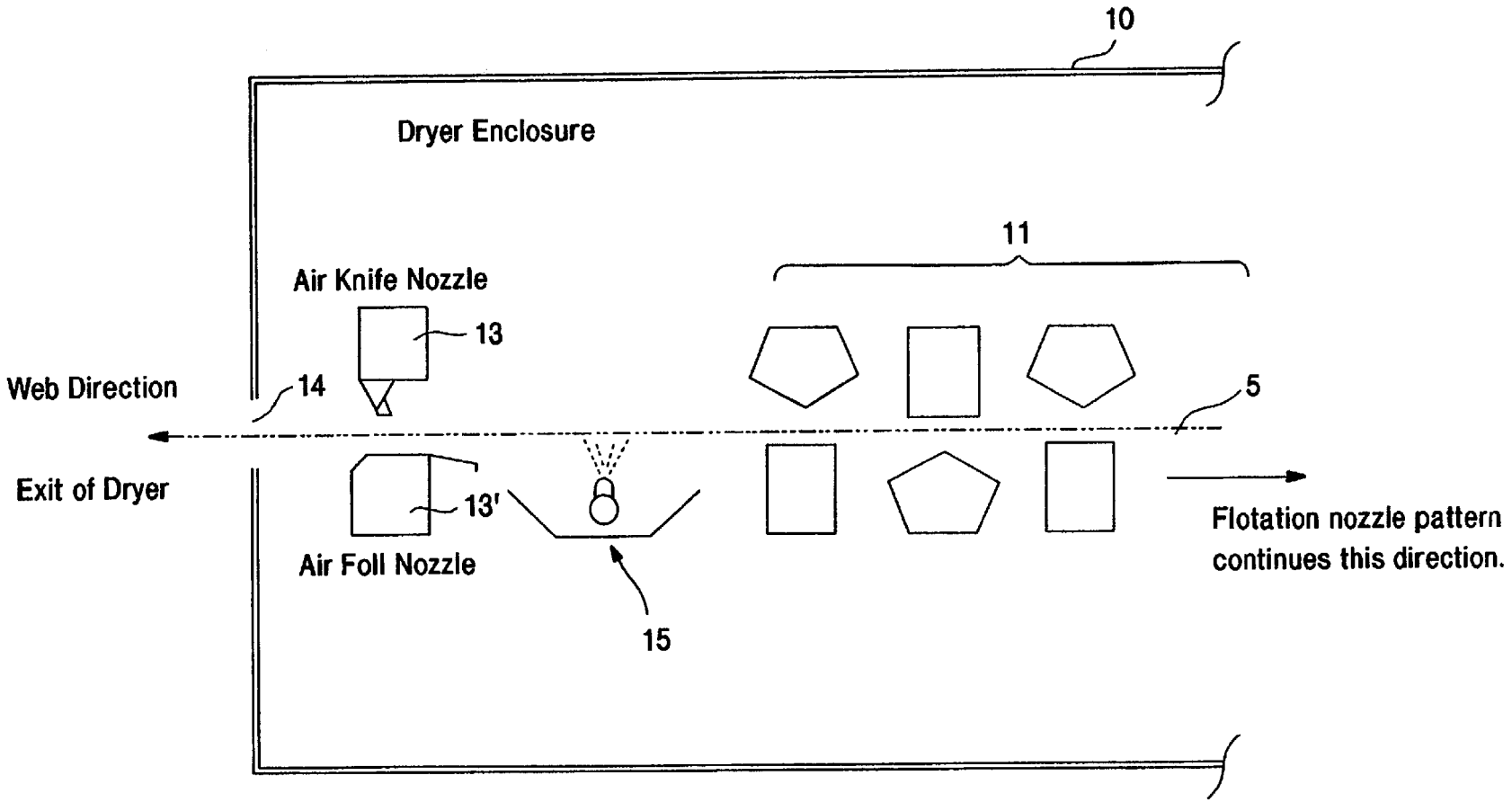
FIG. 1 is a schematic view of one embodiment of the apparatus in accordance with the present invention.

Turning now to FIG. 1, there is shown an enclosure 10, such as a web flotation dryer enclosure, the outer walls of which are preferably insulated. A plurality of upper and lower web flotation bars 11 are in fluid communication with suitable ducting (not shown) and supply heated air to both float and dry the running web 5. Some or all of the flotation bars can be based on the Coanda principle for efficient heat transfer, such as the HI-FLOATS® air bar commercially available from MEGTEC Systems. Located downstream of the air flotation bars 11, in the direction of web travel (right to left in the embodiment shown), is positioned the water spray nozzle and tray assembly 15 of the present invention. A conventional air knife nozzle 13 and/or air foil nozzle 13' can be positioned at or near the web exit slot 14 as shown.

Figure 2:
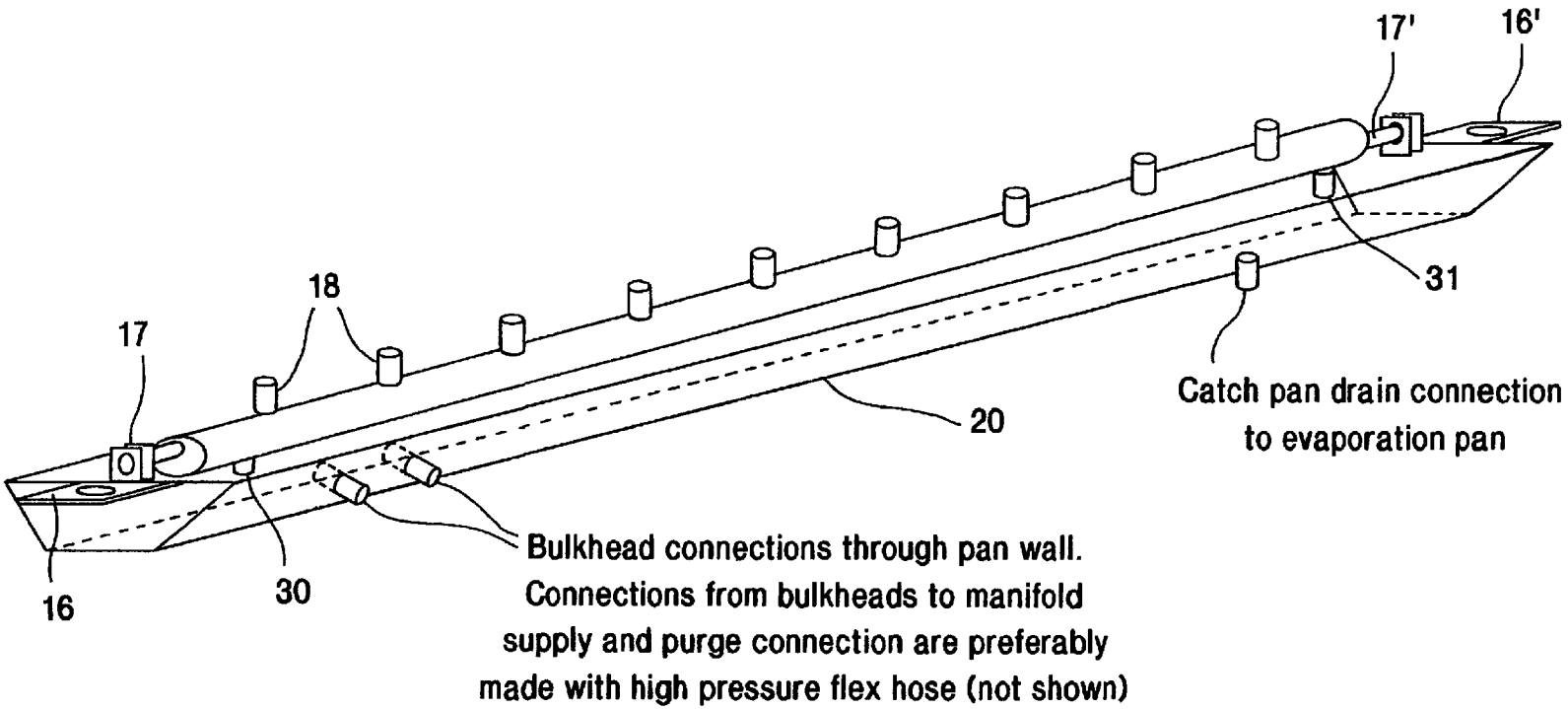
FIG. 2 is a perspective view of a water spray manifold in accordance with the present invention.

FIG. 2 shows a preferred embodiment of the spray manifold 15. A catch pan 20 is mounted to the flotation nozzle support frame (not shown) with spaced mounting tabs 16, 16'. The catch pan 20 is positioned below the nozzles 18 (relative to the web), and catches excess water droplets that do not impinge upon the web and are not otherwise evaporated. The spray manifold 15 is preferably rotatably mounted such as with linkage assemblies 17, 17' in a quick-removal mounting fixture attached to the catch pan 20. An actuator can be used to rotate the manifold assembly so that the nozzles 18 are directed away from the web 5. Affixed to the manifold 15 are a plurality of spray nozzles 18, which are preferably threaded into the manifold pipe. Preferably the nozzles 18 are self-atomizing, are evenly spaced for uniformity, and are positioned close to the web such that the momentum of discharge is sufficiently great enough to overcome the local air currents and air boundary layer near the surface of the moving web. Suitable self-atomizing high pressure spray nozzles are commercially available from Lechler. Suitable spacing of the nozzles 18 is from about 1 to about 4 inches between nozzle discharge orifices. Other nozzle spacings may be selected by those skilled in the art to achieve uniform application of the desired amount of water evenly across the width of the web 5. Operable distances of the spray nozzles 18 from the web 5 are from about 1 to about 4 inches.

Preferably the spray discharge is a flat pattern or is conical, with a spray pattern included angle of 45 to 90 degrees being preferred. Other spray patterns may be chosen, provided-that uniform application of the desired amount of water is achieved. Normal pressures required for proper discharge of the spray are from 50 to 800 psig, which driving force can be provided by commercially available positive displacement pumps.

In a preferred embodiment of the present invention, the quantity of water delivered from the spray nozzles 18 to the web 5 is carefully regulated. Regulation can be accomplished using a variable speed drive in electrical communication with the driving force for the water spray, which is preferably a positive displacement pump. Web exit temperature is measured, preferably in a non-contact manner such as with an infrared pyrometer commercially available from Raytek, and a closed loop control of the water supply pressure is used to control the variable speed drive, which in turn regulates the pump. For example, it is often desirable to cool the web 5 to a temperature within a range of 210 to 230° F. Water delivery to the nozzles 18 is typically controllable within a range of about 0.005 to about 0.03 pounds of water per pound of paper (web) to be cooled, depending upon paper basis weight and temperature conditions. Based upon the measured temperature of the web exiting the dryer, the closed loop control can send a signal to the variable speed drive to supply more or less water to the nozzles 18.

The present invention also provides a means to handle excess water spray that is not deposited directly onto the web 5. Fine spray or mist that remains airborne or is sprayed beyond the edges of the web width is evaporated with a directed flow of hot air from dedicated evaporator nozzles positioned opposite the water spray manifold 15. This enables the processing of webs of any width or position within the maximum limit of the press line without the need for operator intervention or special web width sensors and controls.

Figure 3:
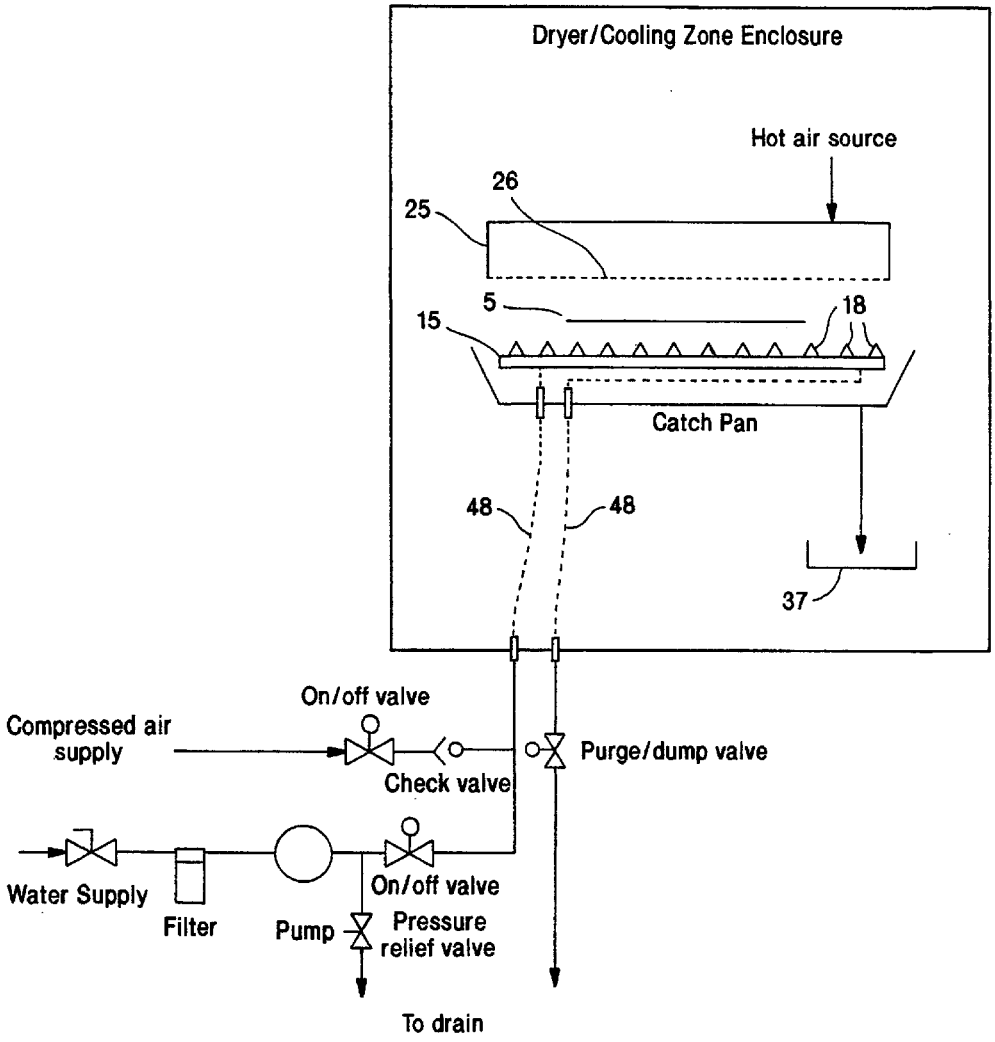
FIG. 3 is a cut-away schematic view of a water spray web cooling device in accordance with the present invention.

Turning now to FIG. 3, one or more evaporator nozzles 25, preferably two or three nozzles 25, are positioned from about 4 to about 12 inches from the discharge of the water spray nozzles 18. The evaporator nozzles 25 are in communication, via suitable ducting (not shown) with a source of hot air, and project a uniform flow of hot air towards the water spray manifold 15. The nozzles may be designed to removably fit the existing positions of a standard air bar dryer nozzle, thereby providing simple connection to the existing ducting and source of hot air. Preferably the hot air has a temperature in the range of about 220 to 250° F. The source of the hot air is not particularly limited, and may be from a separate industrial duty air heater selected by one skilled in the art, or preferably may be taken from an existing hot air plenum in the web dryer 10. The evaporator nozzles 25 preferably include a distribution plate 26 on the discharge face to diffuse the airflow evenly over the entire area of discharge to obtain a discharge air velocity in the range of about 300 to about 1000 feet per minute. Additional flow distributors inside the evaporator nozzle housings may be designed by those skilled in the art in order to obtain the necessary discharge airflow uniformity. The discharge diffuser plate 26 is a perforated plate, having an open area of from about 10 to about 20%, and is preferably removable from the evaporator nozzle 25 for ease of cleaning of potential contaminants such as mineral deposits from water, condensed solvents or paper chards from the web 5.

FIG. 3 also illustrates a compressed air supply with suitable valving feeding the nozzles 18, and a water supply with filter, pump and suitable valving feeding the nozzles 18. Preferably flexible hosing 48 is used to connect the air and water supply for ease of removal.

In a preferred embodiment, two evaporator nozzles 25, each having an inclined discharge face relative to the longitudinal centerline of the web 5, are positioned to form a symmetric concave surface which directs the hot air toward the spray manifold 15 and contains the excess water mist for a sufficient time to completely evaporate the water prior to it depositing on any surface (other than the web).

The spray manifold 15 may be directed upward or downward in the case of horizontal web runs, or may be directed horizontally in the case of a vertical run, or may be directed at virtually any angle necessary to provide directed water spray at approximately 90° to the web 5. Water spray may be applied to one or both sides of the web 5, depending upon the amount of cooling necessary. IN the case of spray applied from above the web 5, the preferred nozzles 18 are of the self-sealing type, which stop flow when supply pressure is below a predetermined level, such as 30 psig, in order to avoid water drippage from the nozzles 18 to the web below.

Another important aspect of the present invention is proper web flotation support and stabilization. In a web span such as that containing the spray manifold and evaporator nozzles of the present invention, it is often necessary to float the web or at least to assist the existing web flotation nozzle system in the dryer. In addition, it is important to contain the laminar air boundary layer that tends to follow the web out of the dryer enclosure in order to reduce fugitive emissions of solvent vapor or steam. Following the web direction, after the web passes the spray nozzles 18, at least one flotation support nozzle is preferred to be located at the exit of the dryer immediately inside the dryer enclosure, or in the case of an add-on dryer enclosure extension, just inside the exit of the enclosure extension. Preferably the flotation support nozzle is an airfoil type nozzle 13' providing single-side support of the web 5 (FIG. 1), positioned on the same side of the web as the spray manifold 15 and in the range of about 5 to about 15 inches away from the manifold 15. The air jet from the airfoil nozzle 13' is directed inward to the enclosure, away from the web exit slot 14, against the direction of web travel. This air jet assists in capturing the boundary layer of air traveling with the web and directs it back into the enclosure. An additional seal air nozzle 13, such as an air knife nozzle, is preferably located directly opposite the airfoil nozzle 13' and also immediately inside the enclosure, to capture and redirect the web boundary layer on the side of the web opposite the spray manifold 15.

Figure 4:
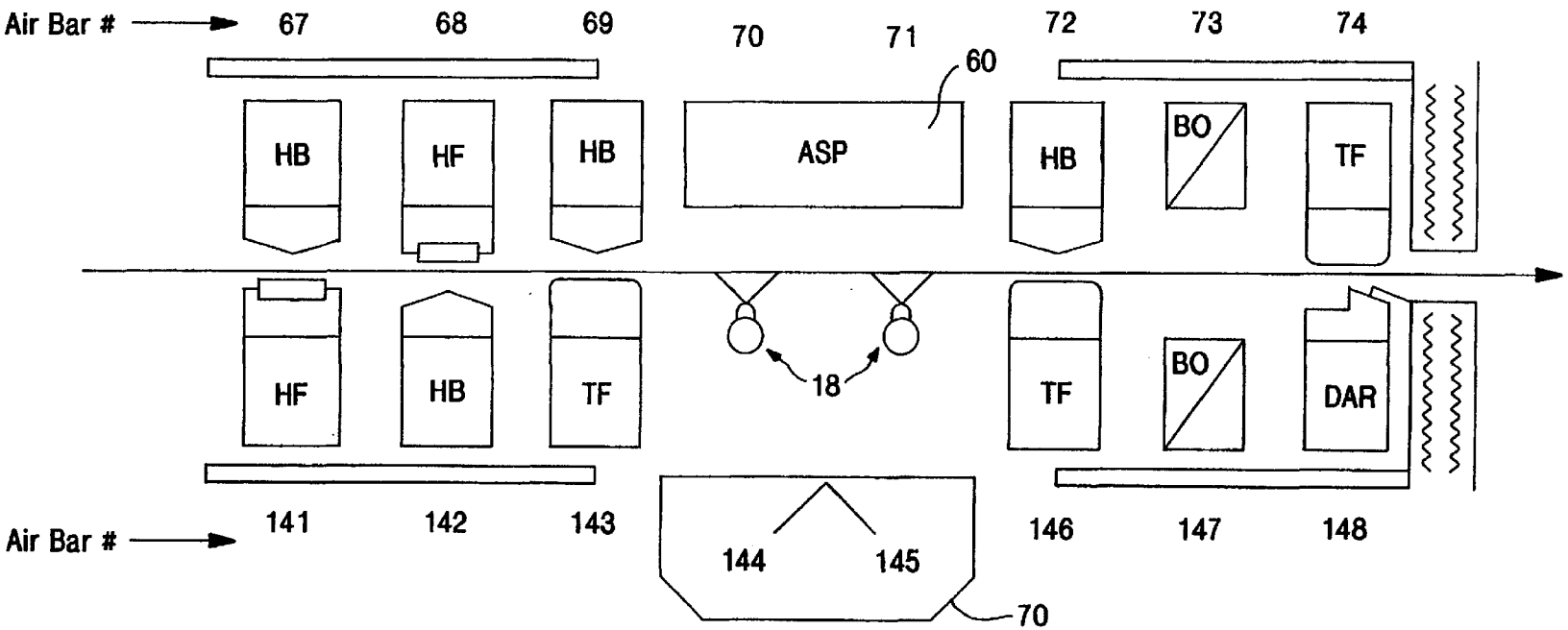
FIG. 4 is a schematic view of another embodiment of the apparatus in accordance with the present invention.
Figure 5:
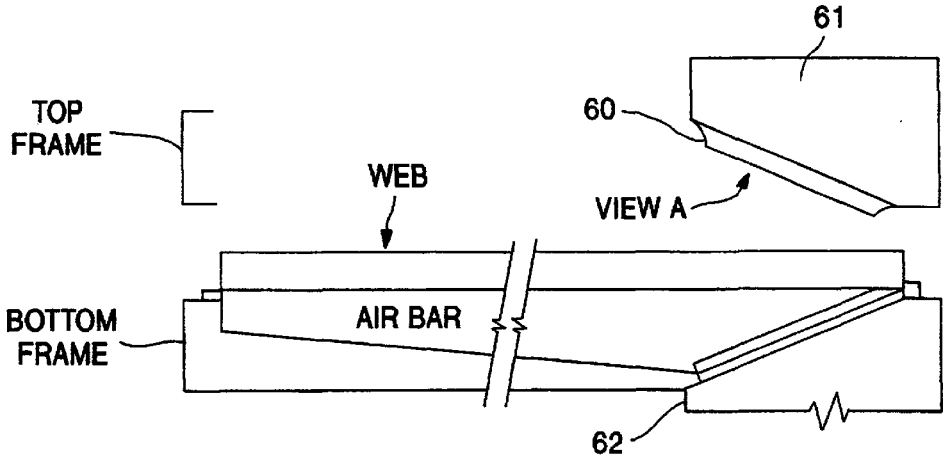
FIG. 5 is a schematic view of the air sweep plate and bottom frame in accordance with the present invention.

In another embodiment of the present invention, an air sweep plate 60 is used to minimize or prevent the area above the water spray nozzles 18 from becoming wet. This arrangement is shown in FIG. 4. The air sweep plate 60 is in communication with the top air supply header 61 as illustrated in FIG. 5. The air sweep plate redirects the air issuing from the top supply header in a direction substantially parallel to the running web. The airflow from the air sweep plate is sufficient to minimize or prevent this area from becoming wet from the spray nozzles.

Figure 6:
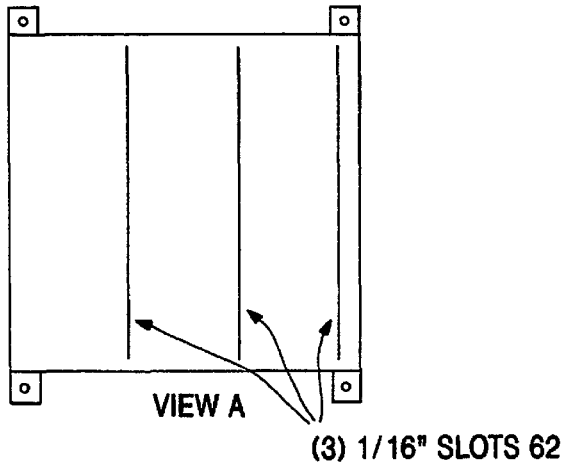
FIG. 6 is a view of the air sweep plate of FIG. 5 taken from View A.
Figure 6A:
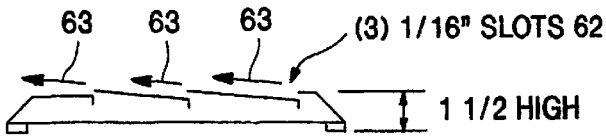
FIG. 6A is a schematic view of the air sweep plate of FIG. 5 showing the air flow pattern.

As shown in FIG. 6, the air sweep plate 60 includes a plurality (three shown) of slots 62, preferably about 1/16" in width and 14" long, suitably angled to redirect the air appropriately. The airflow is depicted by arrows 63 in FIG. 6A.

FIG. 4 also illustrates one preferred air bar and hole bar arrangement in a dryer. Positions 67, 69 and 72 in communication with the upper air supply header 61 are each occupied by a hole bar HB. Position 68 in communication with the upper air supply header is occupied by a HI-FLOAT air bar HF commercially available from Megtec Systems, Inc. Position 73 is covered by a blank off plate BO to prevent air from issuing from the air supply in this area. Position 74 in communication with the upper air supply 61 is occupied by a Thermo Foil air bar TF commercially available from Megtec Systems, Inc.

In communication with the lower air supply header 62, position 141 is occupied by a HI-FLOAT air bar HF an opposes the hole bar HB at position 67. Position 142 is occupied by a hole bar HB and opposes the HI-FLOAT bar HF at position 68. Positions 143 and 146 are each occupied by a Thermo Foil air bar TF and oppose the respective hole bars HB at positions 69 and 72. Position 147 is occupied by a blank off plate BO. A dampered air knife DAK is used at position 148.

In order to improve web handling, a modification of this arrangement can be carried out by dampering the HI-FLOAT air bar HF at position 68, and by replacing the hole bar at position 142 with a blank off plate. FIG. 4 also shows a catch pan 70 below nozzles 18 to collect excess water.

During spray operation, the water supplied for web cooling is also sufficient to cool the manifold 15 and prevent boiling and evaporation within the manifold 15 and nozzles 18. However, printing process conditions require the apparatus to withstand hot air temperatures of 250° or higher without the concurrent operation of the water spray function for certain periods of normal operation. Accordingly, a means of purging the manifold 15 of water during such periods is provided in order to avoid the boiling of water within the manifold 15. This function is necessary to minimize buildup of mineral deposits within the manifold system, which may lead to nozzle plugging and poor atomization of the water, and it reduces the hazard of hot water and steam issuing unexpectedly from the spray manifold 15.

In one embodiment of the present invention, appropriate valving is provided to switch communication of the manifold 15 from a source of water supply to a source of compressed air, for example. Suitable controls are utilized so that the switching occurs when cooling of the web is not called for. Water spray impinging on the web 5 during purging is avoided by rotating the manifold assembly 15 to direct the purge water away from the web and into a catch pan or other receptacle. An alternative method of interrupting the impingement of water spray onto the web during purging is to rotate a shield of metal or other suitable material into position in between the spray nozzle(s) 18 and the web. FIG. 2 shows a manifold water supply connection 30 which, through suitable hosing, provides fluid communication between a water supply source and the manifold 15. The manifold 15 also has a water purge connection 31, which also connects through suitable hosing and allows for the purging feature discussed above.

The manifold 15 also can be purged by again switching from the water supply to a compressed gas supply, while concurrently opening a purge outlet in the water spray manifold 15 in order to empty the contents of the manifold 15 into a drainline or other suitable receptacle. Water from the drainline and catch pan 20 may be directed within the dryer enclosure to an evaporator pan 37 located in the hot dryer environment, thereby eliminating the need for drain disposal of purge or excess water.

Supply water for the manifold 15 preferably should be free of minerals and salts in order to prevent buildup of scale or rust. Mineral-free water may be produced from processes or from potable water by commercially available systems such as reverse osmosis. Although less preferable, soft water may be used, such as that produced by commercial water softeners using an ion exchange process. In the latter case, cleaning and maintenance of the spray manifold and evaporator bars must be undertaken periodically, as the amount of minerals in the supply water is increased. The present invention provides a means for quick removal for cleaning or replacement of the spray manifold and the evaporator nozzle diffuser plate, each of which is designed to be interchangeable with spare elements of the same type. Dirty elements may be rotated out with new or previously cleaned elements in order to minimize downtime for maintenance.

Another feature of the present invention important to keeping the nozzles free of buildup from water minerals or other contaminants is an operational sequence to carry out a high pressure cleaning cycle. In the preferred embodiment, when cooling spray is to be activated, the water pressure to the nozzles is increased to a high pressure in the range of 800 to 1000 psig while directing the spray away from the web by the rotatable means, or by blocking the spray by the use of a shield as discussed above. High pressure is maintained for a controlled period of time, preferably in the range of 5 to 30 seconds, after which normal control pressure is applied. The spray nozzles are then rotated into position (or the shield rotated out of position) to impinge water spray on the web. The high pressure cleaning cycle also may be activated when the web cooling operation is stopped and prior to the air purge cycle. The high pressure cleaning cycle also may be activated manually by an operator.

What is claimed is:

1. Apparatus for the evaporative cooling of a running web, comprising:

a housing having a web inlet and a web outlet;

a spray manifold comprising at least one spray nozzle in fluid communication with a fluid supply for spraying fluid onto a surface of said running web in said housing;

at least one evaporator nozzle opposing said at least one spray nozzle for supplying hot gas towards said spray manifold to evaporate excess fluid sprayed from said plurality of spray nozzles; and at least one flotation support nozzle positioned at said web outlet for directing air inward in said housing and away from said web outlet.

2. The apparatus of claim 1, further comprising a plurality of air bars for floatingly supporting and drying said running web.

3. The apparatus of claim 1, further comprising a receptacle below said manifold for collecting excess fluid.

4. The apparatus of claim 1, wherein said running web is positioned between said at least one evaporator nozzle and said at least one spray nozzle.

5. The apparatus of claim 1, further comprising temperature measuring means for measuring the temperature of said web, and means responsive to said temperature measuring means for controlling the amount of spray emitted by said at least one spray nozzle.

6. The apparatus of claim 1, wherein there are a plurality of spray nozzles.

7. The apparatus of claim 1, wherein there are a plurality of evaporator nozzles.

8. The apparatus of claim 1, wherein said running web has a longitudinal centerline, there are at least two evaporator nozzles, and therein said at least two evaporator nozzles are inclined with respect to said longitudinal centerline.

9. The apparatus of claim 1, wherein said fluid comprises water.

10. The apparatus of claim 1, wherein said manifold is rotatable with respect to said web.

11. The apparatus of claim 1, further comprising an air sweep plate positioned opposite said at least one spray nozzle, said air sweep plate having air issuing therefrom for directing said sprayed fluid in a direction away from said air sweep plate.

12. The apparatus of claim 1, further comprising an air seal nozzle opposite said flotation support nozzle.

13. The apparatus of claim 12, wherein said air seal nozzle is an air knife.

14. Web flotation dryer comprising:

a dryer enclosure having a web inlet and a web outlet spaced from said web inlet;

a plurality of upper and lower air bars in air receiving communication with a supply of heated air;

at least one spray nozzle for directing fluid onto a first surface of said web;

at least one evaporator nozzle positioned facing a second surface of said web opposite said first surface for evaporating fluid sprayed from said plurality of spray nozzles that does not contact said web; and at least one flotation support nozzle positioned at said web outlet for directing air inward to said dryer enclosure and away from said web outlet.

15. The web flotation dryer of claim 14, further comprising a receptacle below said manifold for collecting excess fluid.

16. The web flotation dryer of claim 14, wherein said running web is positioned between said at least one evaporator nozzle and said at least one spray nozzle.

17. The web flotation dryer of claim 14, further comprising temperature measuring means for measuring the temperature of said web, and means responsive to said temperature measuring means for controlling the amount of spray emitted by said at least one spray nozzle.

18. The web flotation dryer of claim 14, wherein there are a plurality of spray nozzles.

19. The web flotation dryer of claim 14, wherein there are a plurality of evaporator nozzles.

20. The web flotation dryer of claim 14, wherein said running web has a longitudinal centerline, there are at least two evaporator nozzles, and wherein said at least two evaporator nozzles are inclined with respect to said longitudinal centerline.

21. The web flotation dryer of claim 14, wherein said at least one spray nozzle is rotatable.

22. The web flotation dryer of claim 14, further comprising an air sweep plate in fluid communication with said supply of heated air and positioned opposite said at least one spray nozzle, said air sweep plate having air issuing therefrom for directing said sprayed fluid in a direction away from said air sweep plate.

* * * * *